US005240136A

United States Patent [19]

Patterson et al.

[11] Patent Number: 5,240,136

[45] Date of Patent: Aug. 31, 1993

[54] PLATE-AND-GLASS ASSEMBLIES

[76] Inventors: Ronald Patterson, 11 Bd Albert-1er, Monte-Carlo, Monaco; John M. Patterson, 20819 229th Ave. SE., Maple Valley, Wash. 98038

[21] Appl. No.: 870,392

[22] Filed: Apr. 17, 1992

Related U.S. Application Data

[63] Continuation-in-part of Ser. No. 832,436, Feb. 7, 1992, Pat. No. 5,176,283.

[51] Int. Cl.[5] ..... B65D 21/02

[52] U.S. Cl. ..... 220/574; 220/23.86; 206/217

[58] Field of Search ..... 220/574, 23.83, 23.86; 206/217, 541

[56] References Cited

U.S. PATENT DOCUMENTS

| | | | |
|---|---|---|---|
| 2,069,048 | 1/1937 | Rehberger | 220/694 X |
| 2,107,309 | 2/1938 | Smith | 215/100 R |
| 2,152,285 | 3/1939 | Schirmer | 220/911 X |
| 3,402,844 | 9/1968 | Chin | 220/694 X |
| 3,522,812 | 8/1970 | Chism et al. | 220/911 X |
| 3,955,672 | 5/1976 | Brundage | 220/23.86 X |
| 4,534,469 | 8/1985 | Elsmo | 206/217 X |
| 4,938,373 | 7/1990 | McKee | 220/23.86 |
| 4,989,742 | 2/1991 | Powell | 220/23.83 X |
| 5,058,737 | 10/1991 | Patterson et al. | 220/23.86 |
| 5,060,820 | 10/1991 | Boerner | 220/23.83 X |
| 5,176,283 | 1/1993 | Patterson et al. | 220/574 |

FOREIGN PATENT DOCUMENTS

| | | | |
|---|---|---|---|
| 978565 | 12/1964 | United Kingdom | 220/23.83 |

*Primary Examiner*—Steven M. Pollard
*Attorney, Agent, or Firm*—Hughes & Multer

[57] ABSTRACT

Plate-and-glass or -container assemblies in which integrally formed or separately fabricated arrays of glass holder components are employed to detachably couple a glass or other container to the plate of the assembly. The container may be of the ubiquitous screw-top type, and other mechanisms for detachably assembling a container of this type to a plate are disclosed.

23 Claims, 8 Drawing Sheets

FIG. 1
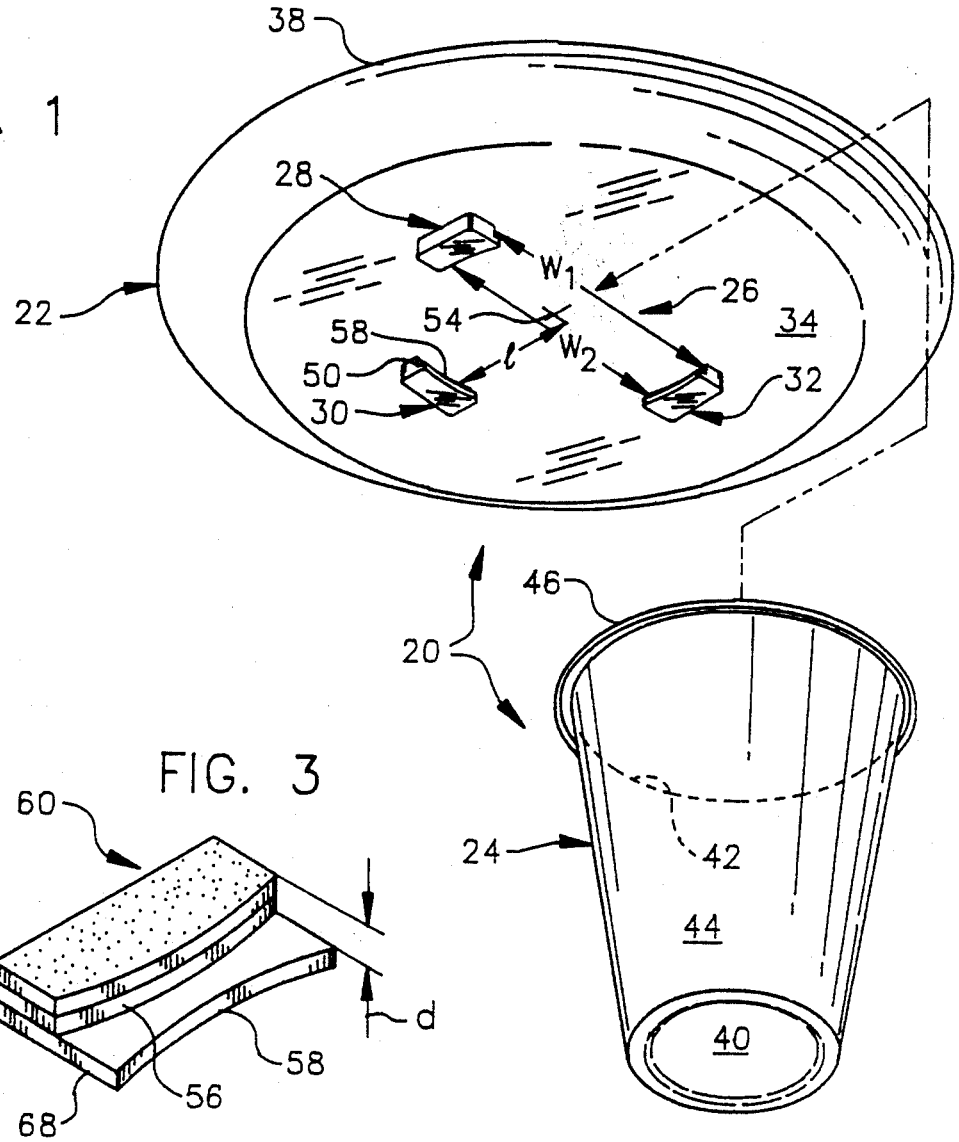
FIG. 3
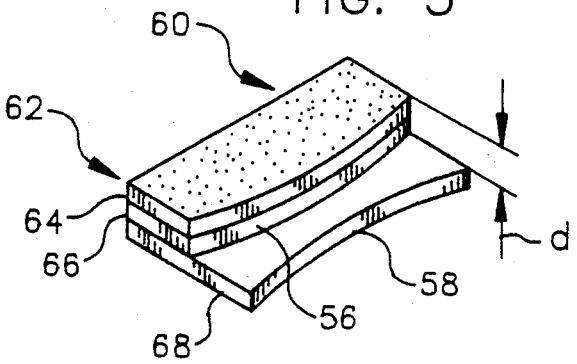
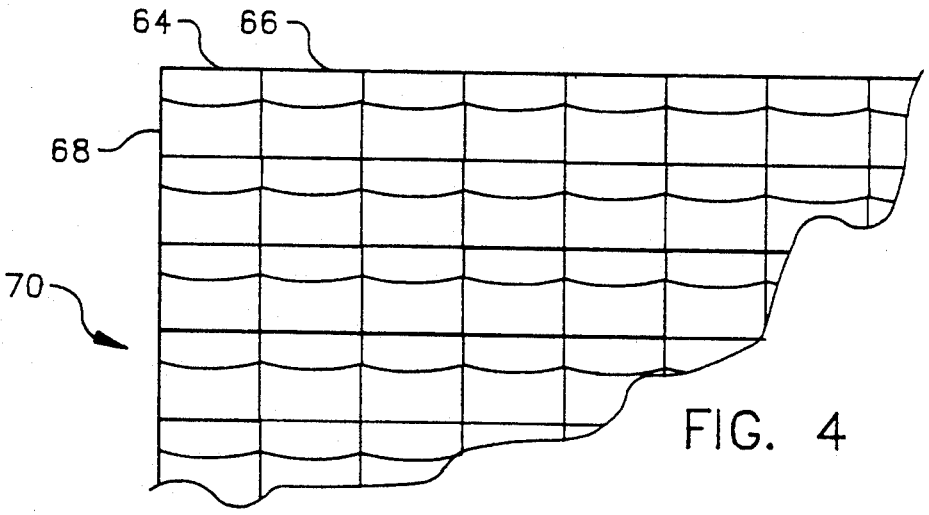
FIG. 4

LOCAPLATE®

PLATE-AND-GLASS ASSEMBLIES

RELATION TO OTHER APPLICATION

This application is a continuation-in-part of U.S. application Ser. No. 07/832,436 filed Feb. 7, 1992, now U.S. Pat. No. 5,176,285, for PLATE-AND-GLASS ASSEMBLIES.

TECHNICAL FIELD OF THE INVENTION

The present invention relates to plates and glasses for serving food and drink. More particularly, the present invention relates to novel, improved assemblies of a plate and a glass which is attachable to the plate to form a unit which can be handled with one hand and to components for such assemblies.

The terms "plate" and "glass" are employed herein in a broad, generic sense. The term "plate" is intended to embrace such diverse artifacts as individual eating dishes and different types of serving dishes. "Glass" encompasses: containers conventionally named by that term, beverage and soup cups; insulated, screw top beverage containers; etc.

BACKGROUND OF THE INVENTION

A number of situations exist in which the use of conventional plates and glasses is difficult. For example, at parties, picnics, and other social gatherings, guests are often obligated to stand or walk about while eating and drinking. Inevitably, they are forced to hold their plate in one hand and their glass in the other. This does not leave free a hand with which to eat. Therefore, the guest must first seek out a resting place for at least the glass. Not only is this inconvenient, but the availability of suitable resting places is frequently quite limited at a social gathering. Furthermore, a guest may be unable to subsequently identify his drink and may recover someone else's drink by mistake It is also frequently difficult to carry a separate plate and glass through a buffet line or when returning to one's seat at a sporting event or movie theater.

Several different assemblies for eliminating the need to use both hands to carry a plate and a glass have been proposed. One is shown in U.S. Pat. No. 2,240,020 issued Apr. 29, 1941 to Raiser. That assembly includes a plate having a central aperture for a cup and a hollow handle which extends downwardly from the cup-receiving receptacle. Although this device permits one to carry both the plate and cup with one hand, the cup is not actually attached to the plate and is thus easily dislodged or overturned. Furthermore, liquid can readily slosh over the open top of the cup and onto the food. Still further the food on the plate can easily come into contact with and foul the exterior of the drinking cup; and food may slosh through the opening in the plate and pass through the hollow handle onto an underlying table or lap.

U.S. Pat. No. 2,920,804 issued Jan. 12, 1960, to Minton discloses a somewhat similar assembly in which a hollow sleeve forms a receptacle for a glass. This sleeve is joined to a plate component by a bead which releasably engages a flange on the plate. U.S. design Pat. No. 211,532 issued Jun. 25, 1968, to Ashton discloses a serving tray having an overall configuration very similar to Minton's. U.S. Pat. No 3,955,672 issued May 11, 1976, to Brundage discloses another plate having a hole in which an open cup is set. In this case, the plate has a channel for balancing the plate on the user's forearm while he grasps the lower end of the cup.

U.S. Pat. No. 4,461,396 issued Jul. 24, 1984, to Harper discloses a plate having a recess for the lower end of a glass in its upper surface. The user's thumb protrudes upwardly through a hole in the plate and presses against the base of the glass to retain it in the recess. This arrangement shares disadvantages with the devices disclosed in the patents cited above. Since the glass is not attached to the plate, momentary relief of thumb pressure may allow the glass to become dislodged; the drink can easily slosh out of the glass and onto the food; the food can slosh through the hole in the plate; and the food contained on the plate can easily get on the outside of the glass U.S. Pat. No. 1,688,992 issued Oct. 23, 1928, to Smith discloses a cup and saucer combination in which the saucer may either support or cover the cup without sliding about. However, the cup and saucer are not attached to each other. U.S. Pat. No. 2,565,912 issued Aug. 28, 1951, to Davis discloses a watercolor paint set in which the palette has a center portion that rests in the mouth of a water container. As the components of these units are not attached to each other, the units have the same disadvantages as Minton's and those of similar character.

The foregoing and other problems appurtenant to the earlier patented arrangements are resolved by the novel plate-and-glass assemblies disclosed in U.S. Pat. No. 5,058,737 issued Oct. 22, 1991 to Patterson et. al. These assemblies are made up of: (a) a plate with a generally horizontal upper surface for supporting food, a lower surface, and a peripheral rim; (b) at least one glass for holding a drink, the glass having an open upper end which forms a mouth; and (c) cooperating connector components for so detachably securing the glass to the lower surface of the plate that the mouth of the glass is covered by the plate and the glass is positioned in an upright orientation when the plate is positioned to support food. In the patented, Patterson et. al. plate-and-glass assemblies, the plate-associated connector component—therein designated a "holder" or "glass holder"—is an integral part of the plate with which it is associated.

It was subsequently found (see U.S. application Ser. No. 07/832,436) that an integrally formed glass holder is not required and that one can instead often employ to advantage a holder fabricated as a separate component and subsequently attached to a plate as with an appropriate adhesive, by thermal or ultrasonic welding, or by any other technique appropriate for a particular application of the invention. This provision of a separately fabricated glass holder makes it possible to provide plate-and-glass assemblies which: (1) have the advantages of those disclosed in the U.S. Pat. No. 5,058,737, but (2) do not require the specially designed plate-with-holder components of the latter. Instead, the novel glass holders disclosed in the parent application allow one to use conventional plates in the plate-and-glass assembly. This has the advantage that the plate can be made of cellulosic and other materials which would perhaps be impractical if the integrated plate-and-glass holder approach disclosed in the U.S. Pat. No. 5,058,737 were employed. Also, the separately fabricated holder gives plate manufacturers an inexpensive entree into the plate-and-glass assembly field.

Separate glass holders of the character disclosed in the parent application have the disadvantage that it is comparatively expensive to mold these components from plastics, and polymers are often the material of choice. Also, available cups—6, 8, and 12 ounce, for example—differ in diameter at their open, upper ends. This requires that a different glass holder, and therefore a different mold, be made available for each different cup size. As a consequence of the foregoing, glass holders as disclosed in the parent application may be too expensive to be used with plates which are not non-disposable.

SUMMARY OF THE INVENTION

It has now been discovered that one-piece glass holders as disclosed in parent U.S. application Ser. No. 07/832,436 are unnecessary and that they can be replaced with a triangular array of inexpensive, easily fabricated and applied glass holder components sometimes hereinafter referred to as "wedges". These novel wedges also have the advantage that their relative spacing can be adjusted, making them capable of accommodating cups of different sizes. Because of the foregoing factors, the present invention makes economically practical the application of glass holders to paper and other disposable plates.

Particularly after a plate has been filled, it may prove difficult to manipulate the plate and glass in the manner employed to slide the glass into the array of glass holder components and thereby lock the glass to the plate. This problem is solved by placing on the upper surface of the plate indicia showing the location of the entrance to the glass holder wedge array and, if desired, the direction in which the glass is to be displaced to lock it to the plate. Such indicia may be incorporated in, or constitute, an aesthetically pleasing design, advertising material, etc. on the plate's upper surface It has also been found that, irrespective of the type of locking mechanism that is employed, plate-and-glass assemblies employing the principles developed in this application; in parent U.S. application Ser. No. 07/832,436; and in U.S. Pat. No. 5,058,737 can be so constructed as to accommodate those currently ubiquitous, plastic, screw top containers provided for soft drinks and other beverages. This is an important advantage at least because of the prevalence of these containers and the consequent number of situations where one is faced with the need to handle both a plate and a container of this character.

The simple provision of a peripheral recess allows a screw top beverage container to be locked to a plate with a glass holder wedge array as disclosed in this application; a locking component as disclosed in the parent application; or an integral locking mechanism as disclosed in the U.S. Pat. No. 5,058,737. Particularly versatile in this respect is the glass holder wedge array disclosed in this specification, which can be used to couple the container to a variety of disposable and other plates. Alternatively, coupling may be provided by a bayonet mechanism with plate-and container-associated elements, by adhesively bonding the container cap to the plate, or by a variety of other mechanisms.

A straw port is formed in the side of the screw cap as the conventional port in the top of the cap is covered by the plate to which the container is connected. A novel accessory strap can be employed to adjust the flexible straw commonly supplied with the container to, and maintain it in, a configuration in which the straw is easily reached by the user when the container is assembled to the plate. An alternate which accomplishes the same objective is to provide an aperture or notch in the rim of the container associable plate through which the flexible straw can be trained.

The objects, features, and advantages of the present invention will be apparent to the reader from the foregoing and the appended claims and as the ensuing detailed description and discussion proceeds in conjunction with the accompanying drawings.

BRIEF DESCRIPTION OF THE DRAWINGS

FIG. 1 is an exploded view of a plate-and-glass assembly employing a glass holder wedge array to detachably couple the glass to the plate in accord with the principles of the present invention;

FIG. 3 is a perspective view of one of three identical glass holder wedges employed in the plate-and-glass assembly of FIG. 1;

FIG. 4 is a plan view of stock material from which the components of a glass holder wedge such as that illustrated in FIG. 3 may be die cut;

DETAILED DESCRIPTION OF THE INVENTION

Figures 2, 5, 6:
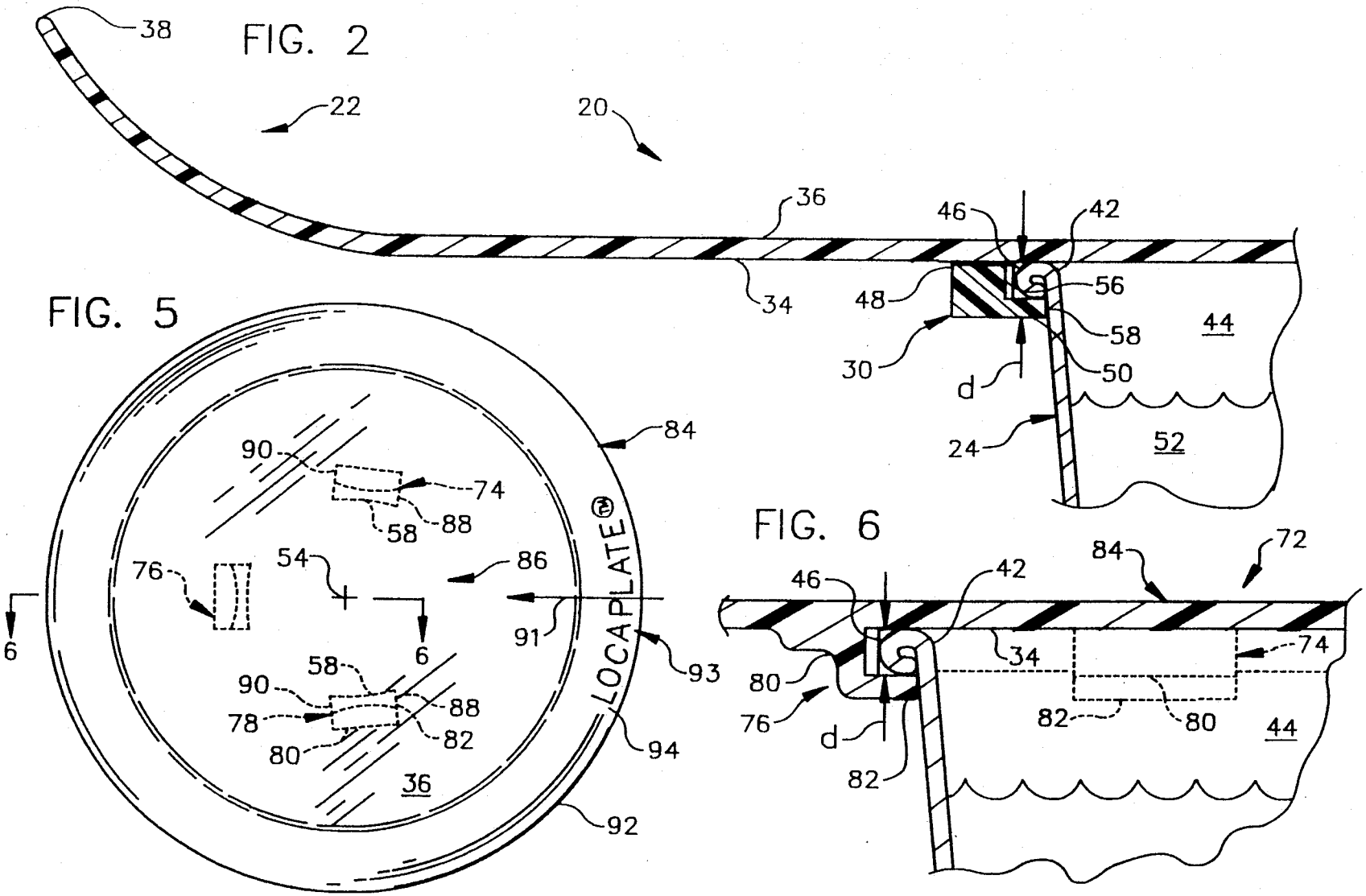
FIG. 2 is a partial vertical section through the plate-and-glass assembly of FIG. 1 with the glass coupled to the plate.
FIG 5 is a plan view of the plate of a second plate-and-glass assembly employing the principles of the present invention; that plate has an integrally molded glass holder wedge array.
FIG. 6 is a section taken substantially along line 6—6 of FIG. 5 and showing an associated glass coupled to the plate of the assembly illustrated in FIG. 5.

Referring now to FIGS. 1 and 2 of the drawing, reference character 20 identifies a plate-and-glass assembly 20 constructed in accord with, and embodying the principles of the present invention. The components of assembly 20 are: a plate 22; a glass or container 24; and a U-shaped array 26 of components 28, 30, and 32 on the bottom side 34 of plate 22 for detachably coupling glass 24 to the plate.

Plate 22 may or may not be of the disposable type, and it may be fabricated from such diverse materials as synthetic polymers (typically a polypropylene or a polystyrene), porcelains and glasses, metals, and cellulosic materials such as the heavier grades of paper.

The illustrated, exemplary plate 22 has: (1) a horizontally orientable, upper, food-receiving surface 36 surrounded by an arcuate, upwardly directed rim 38 which keeps food from sliding off the plate, and (2) the aforementioned lower side or bottom 34 which is in part flat and therefore affords stability when plate 22 is placed on a supporting surface.

The glass 24 assembled to plate 22 in plate-and-glass assembly 20 is of equally conventional construction and can similarly be fabricated from a wide variety of materials including those identified above. This illustrated, exemplary glass 24 has a frustoconical configuration with a closed bottom 40 at one end and an open mouth 42 of somewhat larger diameter at the other. Surrounding the frustoconical wall 44 of the cup at mouth 42 is a radially and outwardly extending, rolled, integral rim or lip 46.

The three identical glass holder components 28, 30, and 32 employed to detachably couple glass 24 to plate 22 are typically fabricated by injection molding from a suitable polystyrene and then bonded to the bottom side 34 of plate 22 with an appropriate adhesive.

Each of these three glass holder components has a main body segment 48 and an integral, protruding flange 50 at one side of the main segment 48. With the holder components 28, 30, and 32 bonded to the bottom side 34 of plate 22 as shown in FIG. 2, the flanges 50 of these three components are spaced from the bottom side 34 of the plate a distance "d" approximately equal to the depth of the lip 46 on glass 24. Thus, with glass 24 assembled to plate 22 as shown in FIG. 2, glass 24 is securely coupled to the plate and trapped against the bottom side 34 of plate 22, keeping the liquid 52 in glass 24 from spilling out of the mouth 42 of the glass.

Turning now to FIG. 1, two of the glass holder components 28 and 32 are fixed in parallel, spaced apart relationship to the bottom side 34 of plate 22 on opposite sides of and at equal distances from the midpoint 54 of the plate with the distance $w_1$ between the apposite edges 56 of these two components approximately equal to the outer diameter of the lip 46 at the mouth 42 of glass 24. The flanges 50 of these two glass holder components 28 and 32 are so dimensioned that the distance $w_2$ between their apposite edges 58 approximates the diameter of the frustoconical side wall 44 at the mouth 42 of the glass.

The third glass holder component 30 is oriented at right angles to components 28 and 32 mid way between those components at one end of array 26 with the distance 1 between the flange edge 58 of that component and the midpoint 54 of glass 24 such that, with the glass coupled to plate 22 by relative rectilinear sliding displacement as shown in FIG. 2 and the rim 46 of the glass consequently trapped between the flange 58 of component 30 and the bottom side 34 of plate 22, the maximum diameter of rim 46 coincides with the midpoint 54 of plate 22 or lies past that midpoint toward glass holder component 30. This ensures that the glass does not come loose from the plate while the plate-and-glass assembly 20 is being used.

It is preferred, though not essential, that the edges 58 of the flanges 50 of glass holder components 28, 30, and 32 have the arcuate configuration shown in FIG. 1. This maximizes surface-to-surface contact between the glass and glass holder components and thereby promotes secure coupling of glass 24 to plate 22.

As mentioned briefly above, one of the important advantages of the novel array 26 of glass holder components just described is the versatility that this novel glass holder mechanism affords. In particular, the dimensions of conventional glasses such as that identified by reference character 24 in FIGS. 1 and 2 at their mouths are similar, varying only from 3.0 inches for a 6 ounce glass to 3.5 inches for a 12 ounce glass. And a perfect match between the contours of holder component flange edges 58 and the frustoconical wall 44 of glass 24 is not essential. As a consequence, a plate-and-glass assembly such as that identified by reference character 20 in FIG. 1 can be fabricated to accommodate these representative different sizes of glasses simply by increasing or decreasing, as appropriate, the spacing $w_1$ and the distance 1 in the course of attaching holder components 28, 30, and 32 to plate 22. The consequence of this and the low cost of manufacturing the glass holder components and attaching them to plate 22 is that the glass holder mechanism 26 may be provided cheaply enough to make it economically practical for throwaway plastic and paper plates.

Referring again to the drawing, an alternative to the molded holder components discussed above is a component of this character fabricated from cellulosic stock or paper. A holder component of that character is illustrated in FIG. 3 and identified by reference character 60. This holder component has a body segment 62 composed of two bonded together lamina 64 and 66 and a flange 68 which is a third lamina and is bonded to lamina or layer 66 of the segment. In one particular application of the invention employing glass holder components as shown in FIG. 3, all three of the lamina or layers 64, 66, and 68 are 0.05 inch thick. Body segment forming lamina 64 and 66 could of course be replaced with a single lamina 0.10 inch thick.

Like the holders 28, 30, and 32 discussed above, those of the character illustrated in FIG. 3 are employed in sets of three; and they are adhesively bonded to the bottom side of a plate such as that identified by reference character 22 in the orientation and with the spacing therebetween discussed above in conjunction with FIGS. 1 and 2. With the holder components 60 thus attached to a plate and a glass such as that identified by reference character 24 installed, the flanges 68 of the glass holder components are spaced that distance d from plate 22. This results in the lip 46 at the open end of the glass being trapped between the flanges 68 of the holder components 60 and the plate 22 to which components 60 are attached.

The lamina 64, 66, and 68 of holder 60 can be fabricated from inexpensive cellulosic sheet stock. Furthermore, these elements can be die cut from a sheet 70 of stock of the appropriate thickness without waste as is shown in FIG. 4. At the same time, wedges of this character even though made from the relatively thin stock identified above are sufficiently rigid as to not give way even under the weight of a completely filled 12 ounce or even larger glass 24.

Particularly in cases involving non-disposable plates, an array of integral as opposed to attached glass holder components may be preferred—for example, to eliminate the possibility of the components coming loose after repeated use and washing. A plate-and-glass assembly with such integral glass holder components is illustrated in FIG. 6 and identified by reference character 72.

Like the separately fabricated components discussed above, those formed as integral parts of a plate have a main body segment and an integral flange. In FIG. 6, and also in FIG. 5, the integrally molded glass holder components are identified by reference characters 74, 76, and 78; the main segment or body 80 of representative component 76 by reference character 80; and the flange of that component by reference character 82. The distance d between the flange and the bottom side 34 of the plate 84 in plate-and-glass assembly 72 is the same lip 46 accommodating distance as in the previously described embodiments of the invention.

Integral glass holder components 74, 76, and 78 have the advantage of being comparatively inexpensive to manufacture in situ in that only push, pull, and twist motions and no sliding movements of mold components are required.

Aside from the use of integrally molded glass holder components, plate 84 differs from the plate 22 illustrated in FIG. 1 and described above in that the two glass holder components 74 and 78 at the sides of glass holder component array 86 are not parallel but are instead canted, bringing the forward edges 88 of these components closer together than the rear or downstream edges 90. This orientation may be employed to optimize contact between the edges 58 of the component flanges 82 and the wall 44 of glass 24, more securely coupling the glass 24 to the plate.

Also, FIG. 5 shows a feature which can be employed to advantage in virtually any plate-and-glass assembly with a glass holder mechanism of the character illustrated in FIGS. 1-6 and described above to facilitate the coupling of the glass of the assembly by rectilinear sliding movement to its associated plate. In particular, it will be appreciated from what has gone before that the glass of an assembly such as that identified by reference character 20 in FIG. 1 or by reference character 72 in FIG. 6 is accomplished by seating the rim 46 of the assembly's glass against the bottom side of the associated plate and then effecting relative displacement between the glass and plate in the direction identified by arrow 91 in FIG. 5. It will also be appreciated that, to effect this relative displacement, the glass must first be positioned on the bottom side 34 of the plate and centered on arrow 91. This is facilitated by providing appropriate indicia 93 on the upper side 36 and near the periphery 92 of plate 84 at the location indicated by reference character 94 in FIG. 5. The indicia 93 may, and will often, take the form of corporate or other advertising.

It was pointed out above that the present invention is also concerned with assemblies of the character discussed above, in the parent application, and the U.S. Pat. No. 5,058,737 in which one component of the assembly is an insulated, screw top beverage container.

Figure 7:
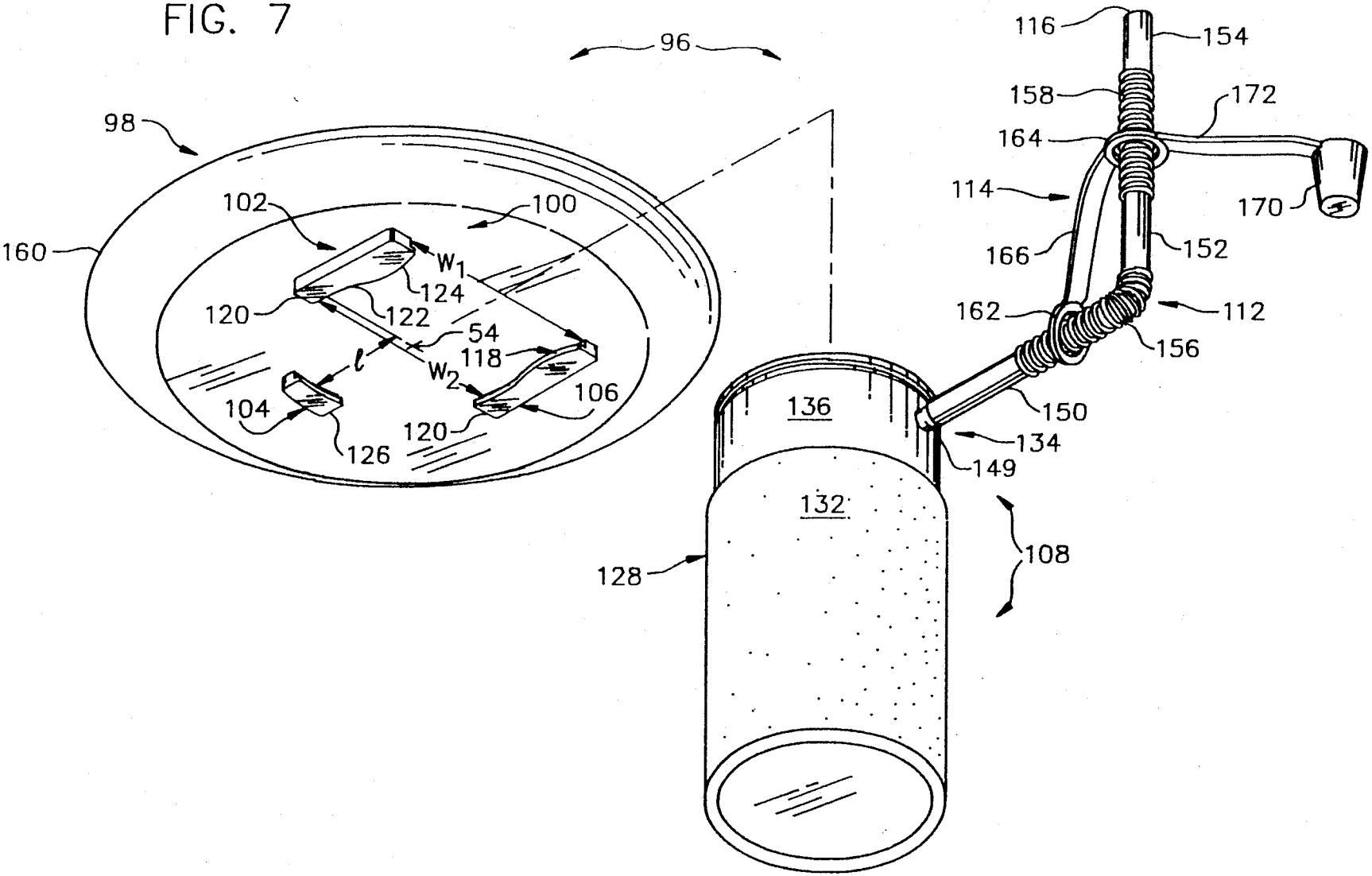
FIG. 7 is an exploded view of a third plate-and-glass assembly which embodies the principles of the present invention; in this embodiment the glass of the assembly is a screw top beverage container with a flexible straw for extracting the contents of the container.
Figure 8:
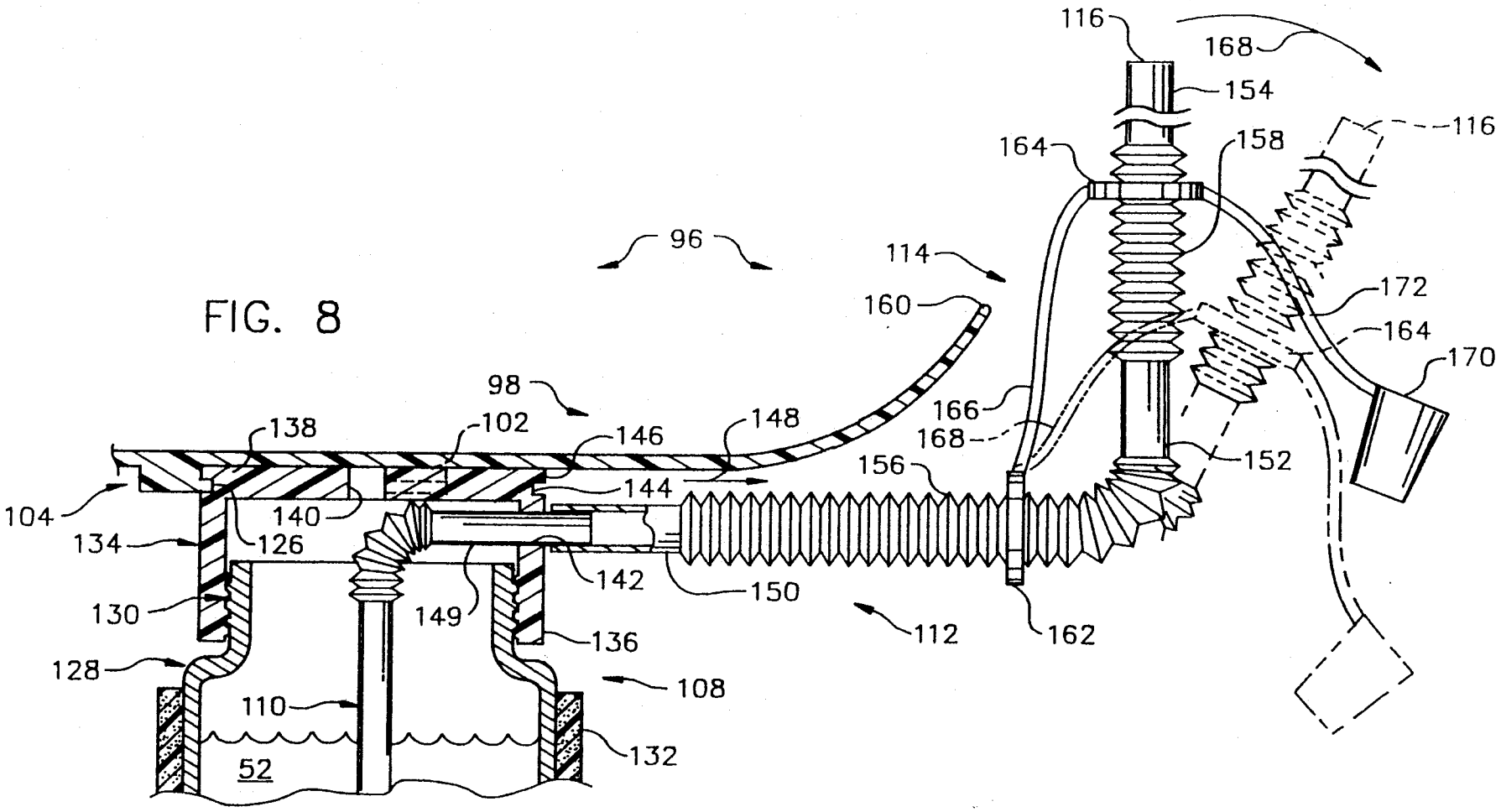
FIG. 8 is a partial vertical section through the plate-and-glass assembly of FIG. 7 with the beverage container assembled to the plate.

One representative assembly of that character, in which the principles of the present invention are embodied, is illustrated in FIGS. 7 and 8 and identified by reference character 96. Plate-and-glass assembly 96 is comprised of a plate 98 with a U-shaped array 100 of glass or container holder components 102, 04, and 106; a screw top beverage container 108; internal and external straws 110 and 112 for extracting liquid 52 from the container; and a unit 114 which can be used to: (1) orient straw 112 for easy access by a user when container 108 is assembled to plate 98, and (2) cap the open end 116 of straw 112 and thereby keep liquid from being inadvertently discharged through that end of the straw.

Depending upon whether plate 98 is designed to be disposable or non-disposable, container holder components 102, 104, and 106 will typically and respectively be integral parts of the plate or separate components adhesively bonded to the bottom side 34 of the plate as is shown in FIG. 7. To compensate for the typically larger and therefore heavier containers of the type shown in that figure, the two container holders 102 and 106 in array 100 are preferably made longer than the third container holder component 104 rather than the same size as the latter as is typically the case in those embodiments of the invention discussed previously. Also, the apposite edges 118 of the flanges 120 on container holder components 102 and 106 have a downstream, concave, beverage container-engaging segment 122 and an integral, convex, upstream segment 124 for trapping container 108 between flanges 120 in the coupled configuration illustrated in FIG. 8. The flange 126 of the third container holder component 104 may have the same arcuate configuration as the similarly oriented components of that character discussed above.

Beverage container 108 is of generally conventional construction. It has a receptacle 128 with an externally threaded upper end 130 surrounded by an expanded polystyrene or other insulating sleeve 132 and a cap or top 134 with an internally threaded side wall 136 and an integral top wall 138 in which the customary port 140 for a drinking straw is formed.

Cap 134 differs somewhat from its conventional counterpart, primarily in that: (1) a second drinking straw port 142 is formed through its side wall 136, and (2) a circumferential annular groove 144 is formed in and near the upper edge of side wall 136. This groove opens onto the periphery 146 of the cap. With container 108 assembled to plate 98 by rectilinear relative sliding movement as shown in FIG. 7, the flanges 118 of container holder components 102 and 106 and the flange 126 of the third container holder component 104 are trapped in the groove 144 in cap 134, coupling container 108 to plate 98. And, as indicated above, the convex segments 124 of the two container holder components 102 and 106 then so surround the side wall 136 of cap 134 as to keep it from becoming disconnected by sliding in the direction indicated by arrow 148 in FIG. 8.

With container 108 coupled to plate 98 in the manner just described, the otherwise usable straw port 140 in the top wall 138 of container screw cap 134 is blocked; and the rigid upper end segment 149 of the straw 110 in receptacle 128 is instead trained through the alternately employable straw port 142 in screw cap side wall 136. The upper end segment 149 of straw 110 protrudes beyond screw cap side wall 136. That allows the second, external straw 112 to be coupled to the straw 110 in container receptacle 128 by sliding the rigid lower end segment 150 of external straw 112 onto the exposed end segment 149 of straw 110.

External straw 112 is conventional. It has the just-mentioned rigid lower end segment 150 and rigid mid and upper end segments 152 and 154. The rigid segments are separated by integral, corrugated, flexible segments 156 and 158 which allow external straw 112 to be bent to configurations selected by user—for example, those shown in solid and phantom lines in FIG. 8.

Typically (see FIG. 8), external straw 112 will be bent into a L- or V-shaped configuration to clear the periphery 160 of plate 98 and to make the mouth engageable outlet 116 of the straw readily accessible to the user from above the plate. As suggested above, straw 112 is kept in the selected configuration by the plate-and-glass assembly unit 114.

Referring now to both FIG. 7 and FIG. 8, that unit has two apertured elements 162 and 164 which respectively surround and can be displaced along the flexible, corrugated segments 156 and 158 of straw 112 and a flexible strap 166 extending between and connected at opposite ends to elements 162 and 164. With elements 162 and 164 located as shown in FIG. 8, straw 112 is constrained to the L-shaped configuration shown in FIG. 8. However, by moving element 164 closer to element 162 as shown in phantom lines in the same figure, straw 112 can relax in the direction indicated by arrow 168 into the V-shaped configuration shown in the same figure.

Particularly if external straw 112 were to be inadvertently disturbed in a manner which would result in opening or outlet 116 facing in a downward direction, liquid 52 might accidentally be discharged through the straw. To preclude this, plate-and-glass assembly 114 can be equipped with a cap 170 which can be installed on the rigid upper segment 154 of straw 112 to close opening 116. Cap 170 is preferably connected to the straw surrounding element 164 of unit 114 as by the illustrated flexible strap 172 to keep the cap from being lost while allowing it to be easily installed on external straw segment 154 to close outlet 116 (see FIG. 7).

As indicated above, it is not necessary that plate-and-glass assemblies with screw top beverage containers also have the multicomponent type of glass holder mechanism disclosed herein for coupling the beverage container to an associated plate or that the screw top of the container even be detachable from the plate. Instead, the screw cap of the container may be permanently affixed to the plate and the receptacle of the container screwed into the cap to complete the assembly.

Figure 9:
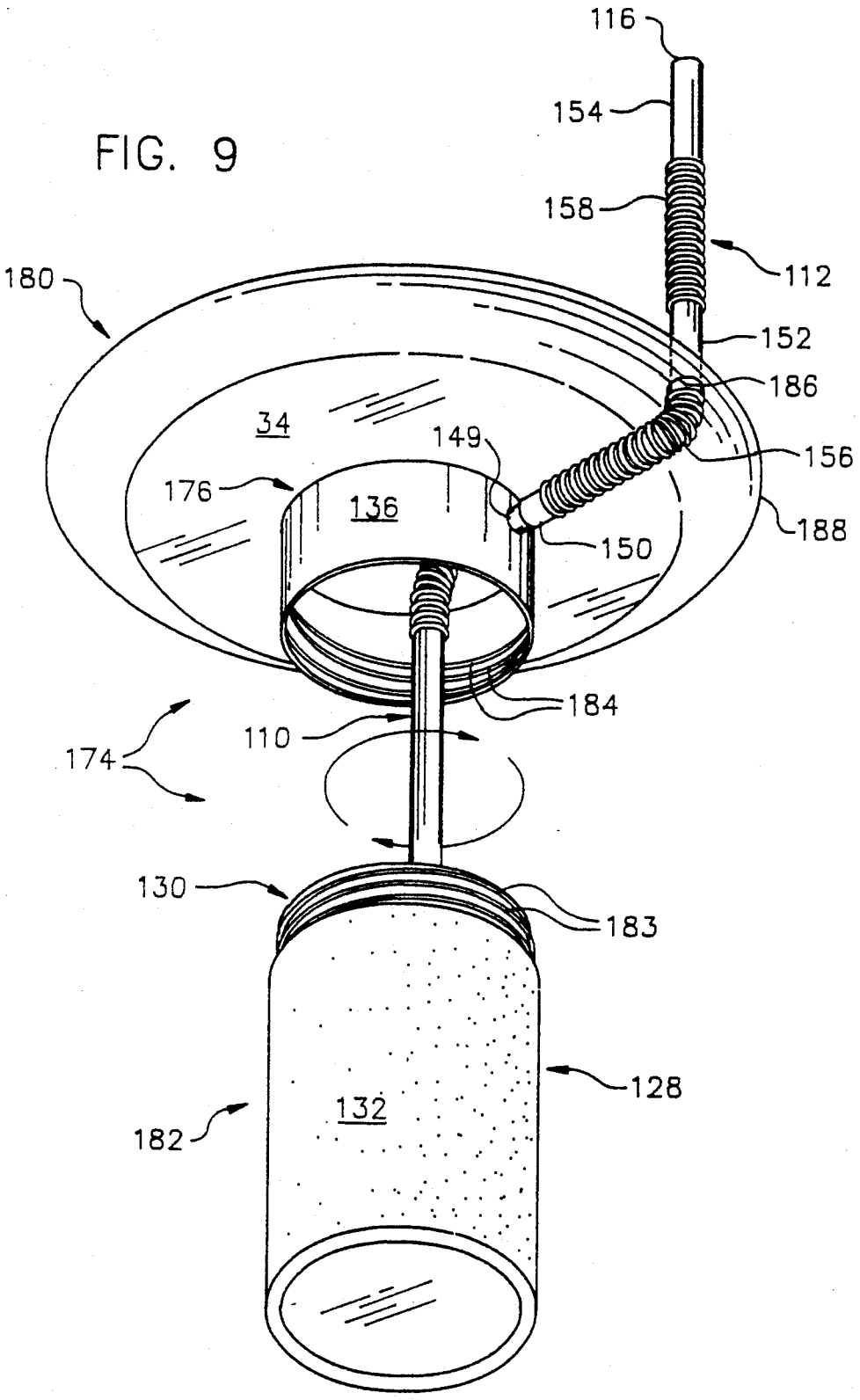
FIG. 9 is an exploded view of a fourth plate-and-glass assembly employing the principles of the present invention; this assembly also has a screw top beverage container.
Figures 10, 11, 11A:
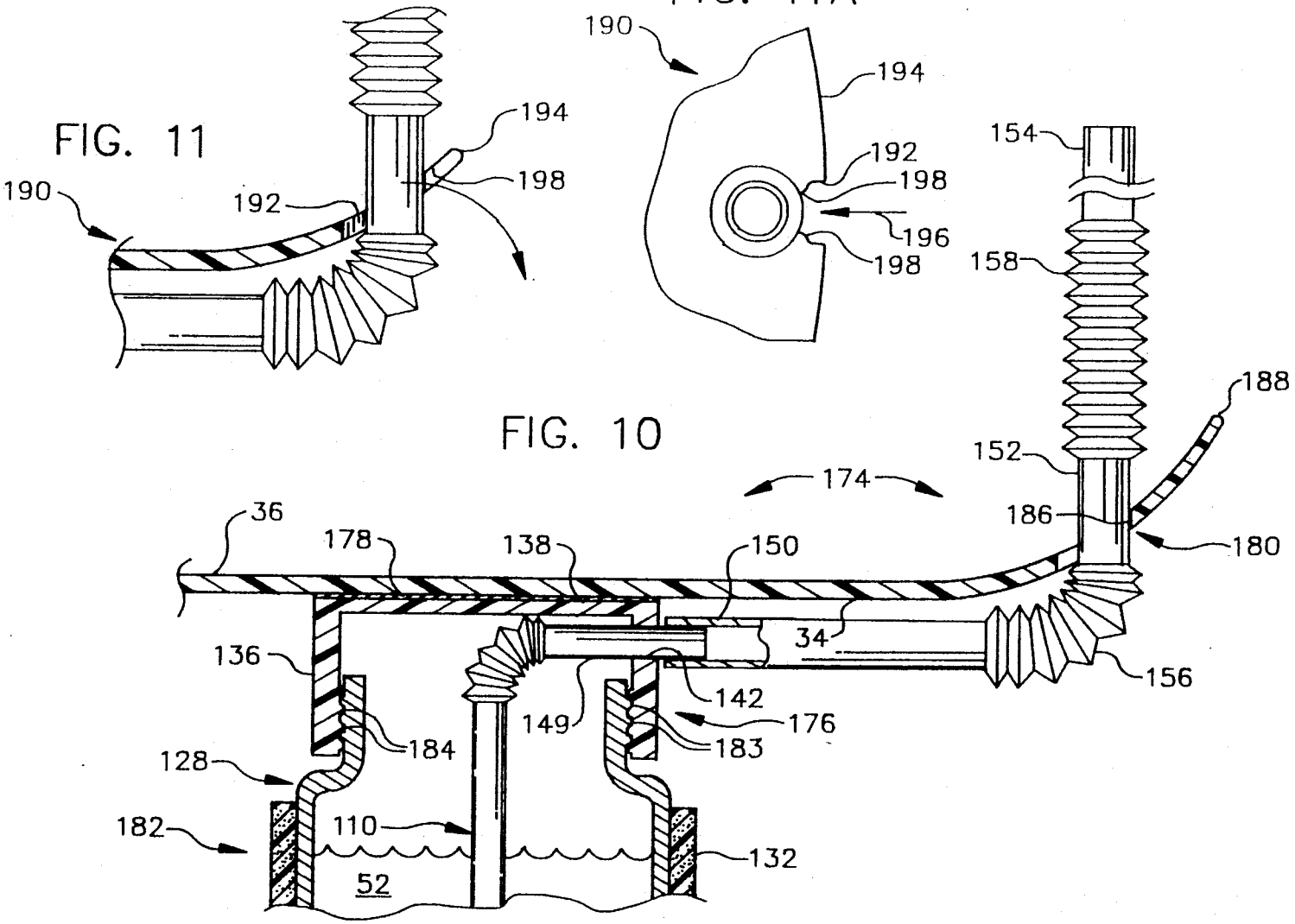
FIG. 10 is a partial section through the plate-and-glass assembly of FIG. 9 with the container coupled to the plate and a container accessing straw trained through an aperture in the rim of the plate to orient the straw in a manner convenient for a user.
FIG. 11 is a fragmentary section through a fifth plate-and-glass assembly in accord with the principles of the present invention; this plate-and-glass assembly differs from the one illustrated in FIG. 10 primarily in that the rim of the plate is notched to accommodate and orient the container accessing straw.
FIG. 11A is a fragmentary view looking in the direction indicated by arrows 11A—11A in FIG. 11.

One representative plate-and-container assembly of the character just described is illustrated in FIGS. 9 and 10 and identified by reference character 174. In this assembly, the top wall 138 of screw cap 176 is fastened with an appropriate adhesive 178 to the bottom side 34 of plate 180. The insulated receptacle 128 of the container 182 is first filled with a selected liquid or other substance and then screwed into the cap with the external threads 183 on the upper end 130 of receptacle 128 engaging threads 184 in cap 176 to securely couple receptacle 128 to the cap.

Cap 176 has the advantage of potentially being somewhat cheaper to manufacture than the cap 134 illustrated FIGS. 7 and 8. Because the cap is permanently attached to plate 180, a straw port in the upper wall 138 of the cap and a peripheral groove such as that identified by reference character 144 in FIG. 8 are both superfluous; and the cost of providing this groove and port can be eliminated.

Plate-and-glass assembly 174 also differs from its counterpart shown in FIGS. 8 and 9 by virtue of the unit 114 employed in the latter to maintain external straw 112 in a selected orientation being eliminated. Instead, this same objective is realized by forming an aperture 186 through plate 180 near its rim 188 and training external straw 112 through this aperture with the rigid mid section 152 of the straw engaged by the plate. This is effective to maintain external straw 112 in the easily accessed, L-shaped configuration shown in FIGS. 9 and 10.

An alternative is to form in the plate of the assembly a notch opening onto its periphery. A plate of this character is illustrated in FIGS. 11 and 11A and identified by reference character 190.

The straw receiving and orienting aperture 192 in this plate has a keyhole configuration, and the aperture opens onto the periphery 194 of the plate. With the intermediate rigid section 152 of the straw seated in this aperture by moving it in the direction indicated by arrow 196 (see FIG. 11A), integral, facing projections 198 engage the straw and keep it in place.

Figure 12:
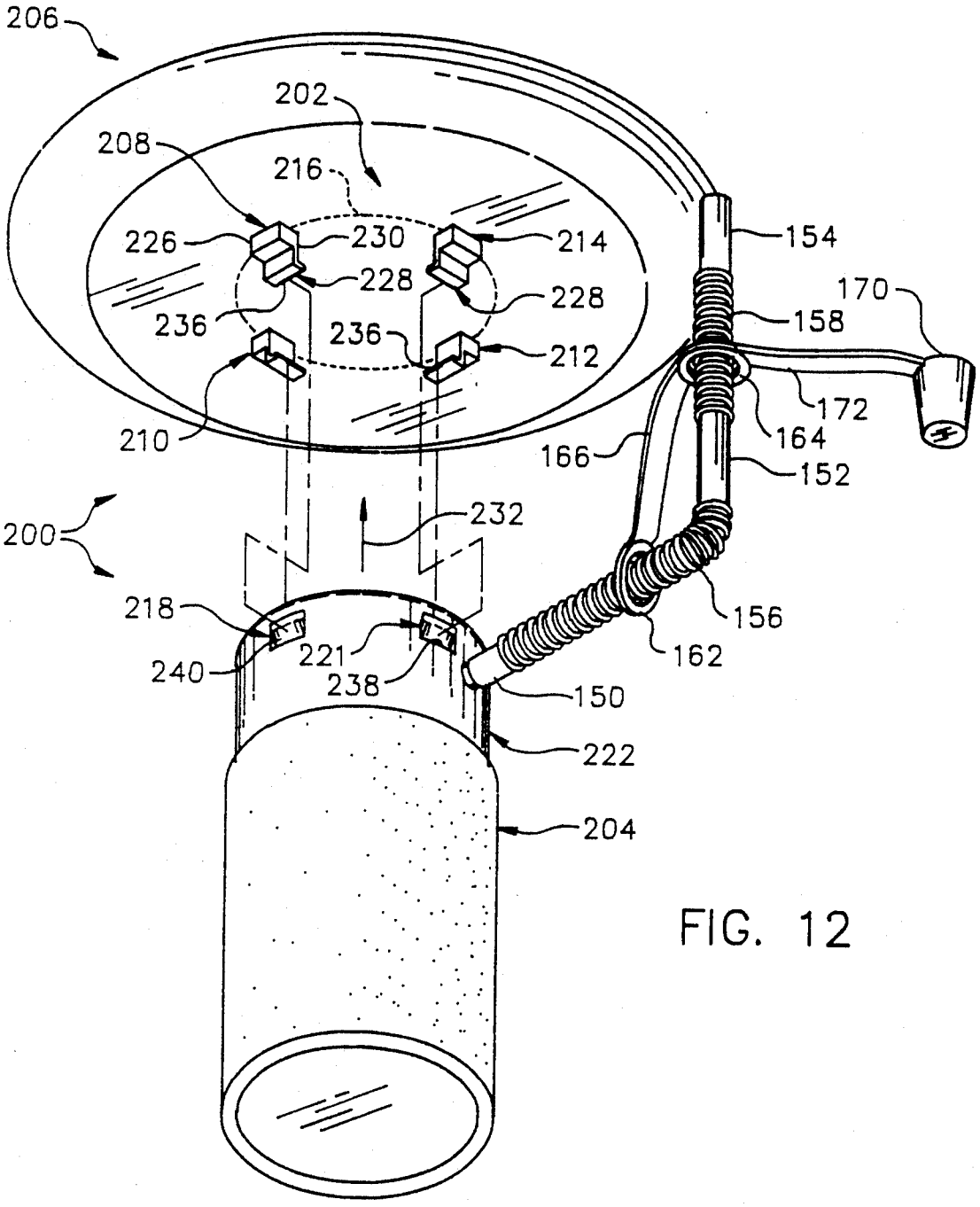
FIG. 12 is an exploded view of a sixth plate-and-glass assembly employing the principles of the present invention; this assembly also utilizes a screw top container but has a different system for coupling that container to the associable plate of the assembly.
Figure 13:
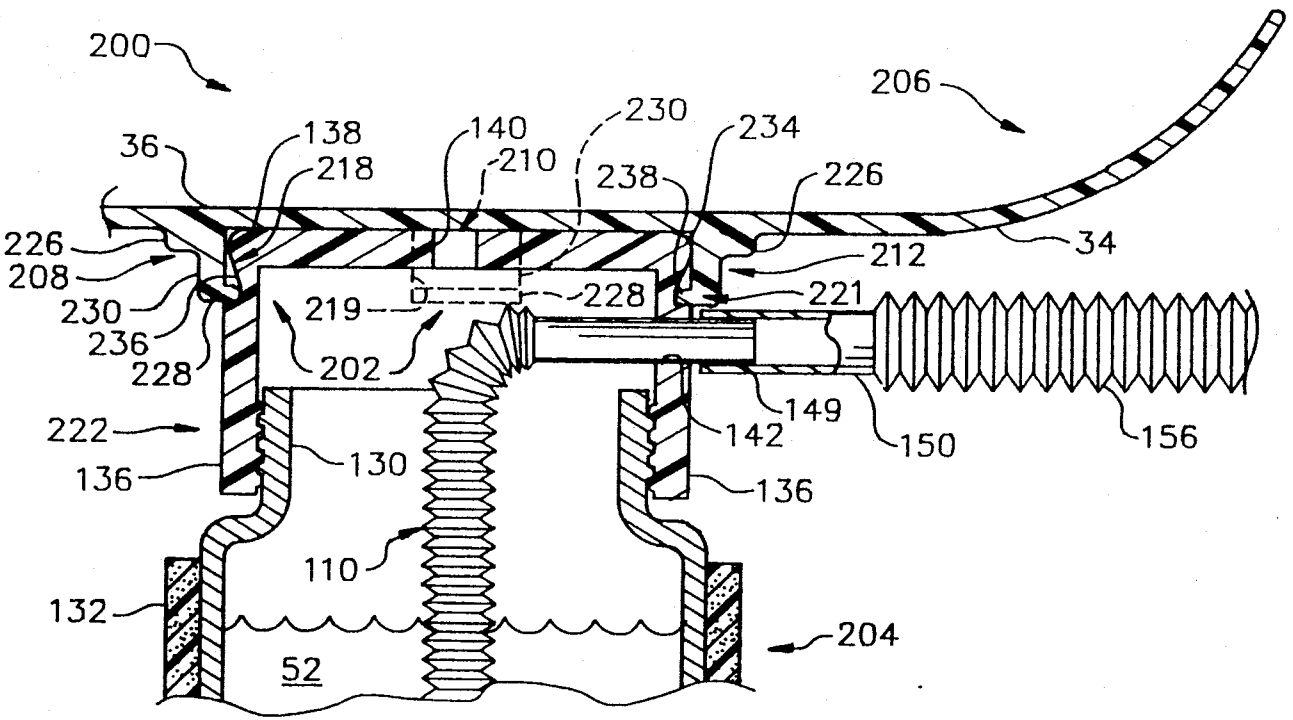
FIG. 13 is a partial fragmentary view through a plate-and-glass assembly as illustrated in FIG. 12 with the container coupled to the plate of the assembly.

FIGS. 12 and 13 depict a plate-and-container assembly 200 which differs from its counterpart shown in FIGS. 7 and 8 in that it employs a bayonet locking mechanism 202 to detachably couple insulated container 204 to the plate 206 of the assembly. This locking mechanism includes a set of separately fabricated, identical, snap-in fittings 208 . . . 214 fixed to the bottom side 34 of plate 206 at equal intervals around a circle 216 centered on the midpoint 54 of the plate and complementary apertures 218 . . . 221 in the side wall 136 of beverage container screw cap 222 adjacent the top wall 138 of that cap.

Each of the snap in-retainers 208 . . . 214 has a rigid body 226 fastened by an appropriate adhesive to the bottom side 34 of plate 206; an inwardly facing, cap-recess-engaging retaining element 228 oriented in parallel, spaced relationship to the plate's bottom side 34; and a flexible, normally extending, vertical leg 230 connecting the retaining element 228 to the body 226 of the fastener.

Beverage container 204 is assembled to plate 206 of assembly 200 by displacing it upwardly relative to the plate as suggested by arrow 232 in FIG. 12. A tapered or rounded off upper edge portion 234 of cap side wall 136 with a diameter at the top wall 138 of the cap smaller than the diameter of a circle tangent to the inner edges 236 of integral fastener elements 228 facilitates this displacement by allowing the fastener elements 228 to clear the upper end of the cap. Thereafter, as container 204 moves toward plate 206 as indicated by arrow 232, the retainer elements 228 of the several fasteners 208 . . . 214 spread apart due to the flexibility in fastener segments 230. Ultimately, these fastener elements are seated in the lower ends 238 of the complementary, screw cap associated recesses 218 . . . 221 with the top wall 138 of the cap abutting the bottom side 34 of plate 206 to complete the assembly process.

As is perhaps best shown in FIG. 13, it is equally easy to remove insulated beverage container 204 from plate 206. Specifically, the cap-associated recesses 218 . .. 221 have upwardly and outwardly inclined inner end surfaces 240. In removing container 204 by moving it in the direction opposite that indicated by arrow 232, fastener elements 228 simply ride up these surfaces, eliminating any binding or other obstruction to the removal of the container.

It is to be reemphasized that, like the embodiments of the invention depicted FIGS. 1–6, those illustrated in FIGS. 7–13 are only representative and that an endless variety of other plate-and-container assemblies of the general character shown in those figures also lie within the scope of the invention. For example, the screw cap of the container may, as an alternative, be an integrally molded component of the assembly's plate. Another, representative alternative is to replace the internal/external, flexible straw arrangement illustrated in the drawings with a single flexible straw. The illustrated arrangement is, in this respect, preferred primarily to make the straw easier to remove from the cap of the insulated container as may be necessary to adequately clean the interior of the screw cap. Many other alternatives will readily occur to the audience to which this specification is addressed.

Thus, the invention may be embodied in many forms without departing from the spirit or essential characteristics of the invention. The present embodiments are therefore to be considered in all respects as illustrative and not restrictive. The scope of the invention is indicated by the appended claims rather than by the foregoing description; and all changes which come within the meaning and range of equivalency of the claims are therefore intended to be embraced therein.

What is claimed is:

1. A plate-and-container assembly comprising:
a plate with a food-receiving surface and a lower side;
a container with a radial rim at an open end thereof; and
an array of separate, spaced apart, container holder components on the lower side of the plate;
said container holder components and said plate cooperating to allow sliding displacement of the container relative to the plate in a plane paralleling the lower side of the plate and said holder components having means so engageable with the rim on the container as to trap said rim against the lower side of the plate as the container is displaced relative to the plate in said plane and thereby so couple said container to said plate that said container is in an upright orientation when said plate is horizontally oriented.

2. A plate-and-container assembly as defined in claim 1 in which each said glass holder component has:
a plate-associated main body portion; and
flange means protruding from said main body portion in spaced relation to the bottom side of the plate for trapping the rim at the open end of the glass against the lower side of the plate as the glass is displaced relative to the plate to thereby detachably couple the glass to the plate.

3. A plate-and-container assembly as defined in claim 2 which has means on that side of each container holder component main body portion opposite the rim trapping means for fixing the glass holder component to the plate.

4. A plate-and-container assembly as defined in claim 1 in which the container holder components are fabricated from a thermoformable polymer and are separate and independent from the plate.

5. A plate-and-container assembly as defined in claim 4 in which the means fixing each said holder component to the plate is a layer of adhesive.

6. A plate-and-container assembly as defined in claim 1 in which the plate is made of a thermoformable polymer and the container holder components are integral parts of the plate.

7. A plate-and-container assembly as defined in claim 1 in which the container holder components comprise multiple layers of cellulosic material.

8. A plate-and-container assembly comprising:
a plate with a food-receiving surface and a lower side;
a container with a removably screw top; and
means for integrating the screw top of the container with the lower side of the plate;
the means for integrating the container screw top with the plate of the assembly comprising a U-shaped array of locking wedges on the lower side of the plate and cooperating therewith to allow relative sliding displacement of the screw top relative to the plate in a plane paralleling the lower side of the plate and said locking wedges having means so engageable with said screw top as it is displaced in said plane relative to the plate as to trap said screw top against and couple it to said plate.

9. A plate-and-container assembly as defined in claim 8 in which said array has three locking wedges, the locking wedges being longer than the third, said two locking wedges being disposed in parallel spaced apart relationship at equal distances from the midpoint of the plate, and the third locking wedge being oriented at right angles to said two wedges at one end of the array.

10. A plate-and-container assembly as defined in claim 8 in which:
there is a groove in the periphery of the container screw top; and
said wedges have means so engageable in said groove as the screw top is displaced relative to the plate as to trap said screw top against the lower side of the plate.

11. A plate-and-container assembly as defined in claim 8 in which the locking wedges are integral components of the plate.

12. A plate-and-container assembly as defined in claim 8 in which the locking wedges are separate components fixed to the lower side of the plate.

13. A plate-and-container assembly comprising;
a plate with a food-receiving surface and a lower side;
a container with a removable screw top; and
means for integrating the screw top of the container with the lower side of the plate;
the means for integrating the container screw top with the plate of the assembly comprising an array of snap-in fittings on the lower side of the plate and a complementary array of recesses spaced around and opening onto the periphery of the container screw top.

14. A plate-and-container assembly as defined in claim 13 in which the snap-in fittings are equiangularly spaced around a circle having a center coinciding with the midpoint of the plate.

15. A plate-and-container assembly as defined in claim 13 in which the recesses in the container screw top have bevelled upper edges which facilitate the removal of the screw top from the plate by facilitating the movement of the snap-in fittings out of the recesses.

16. A plate-and-container assembly comprising;
a plate with a food-receiving surface and a lower side;
a container with a removably screw top;
means for integrating the screw top of the container with the lower side of the plate; and
means for extracting the contents of the container without removing the container from the plate;
the screw top having a wall buttable against the lower side of the plate and a side wall with a straw port and the contents accessing means comprising a straw extending to the periphery of the container through the straw port.

17. A plate-and-container assembly as defined in claim 16 which has a flexible straw connected to that end of the first mentioned straw and trained around and upwardly past said plate to facilitate the extraction of the container contents.

18. A plate-and-container assembly as defined in claim 17 in which:

the flexible straw has two relatively displacable segments, it being one of said segments that is connected to said first-mentioned straw; and the assembly further comprising means for so orienting the other segment of the flexible straw as to make an exposed end of that straw readily accessible to a user as aforesaid when the container is assembled to the plate.

19. A plate-and-container assembly as defined in claim 18 in which the means for orienting said other segment of the flexible straw comprises an aperture in the rim of said plate.

20. A plate-and-container assembly a defined in claim 18 in which the means for orienting said other segment of said flexible straw comprises a notch in the rim of and opening onto the periphery of the plate.

21. A plate-and-container assembly as defined in claim 18 in the means for orienting said other segment of said flexible straw has one component displacable to a selected location along one segment of the flexible straw, a second component adjustable to a related position along the other segment of the flexible straw, and a flexible link extending between and connected to said first and second components.

22. A plate-and-container assembly as defined in claim 21 which has:

a cap that can be installed on said exposed end of said second flexible straw segment to keep contents of the container from discharging through said end and a flexible member connecting said cap to an element of the straw orienting means.

23. A plate-and-container assembly comprising:

a plate with a food-receiving surface and a lower side;

a container with a radial rim at an open end thereof; and an array of separate, spaced apart, container holder components on the lower side of the plate;

said container holder components and said plate cooperating to allow sliding displacement of the container relative to the plate and said holder components having means so engageable with the rim on the container as to trap said rim against the lower side of the plate as the container is displaced relative to the plate and thereby so couple said container to said plate that said container is in an upright orientation when said plate is horizontally oriented;

there being a U-shaped array of the container holder components with two of said components being so disposed in parallel spaced relationship with the third component oriented normal thereto at one end of the array that the container can be coupled to the plate of the assembly by displacing the container along a rectilinear path from a specific locus on the edge of the plate between said two container holder components and toward the third container component; and said assembly also including means visible on the upper edge of the plate for identifying said locus.

* * * * *